US006095480A

United States Patent [19]

Mutschler

[11] Patent Number: 6,095,480

[45] **Date of Patent: *Aug. 1, 2000**

[54] STANDS FOR CHRISTMAS TREES OR THE LIKE

[76] Inventor: Friedolf Mutschler, Siechberg 54, Ochsenhausen, Germany, 88416

[ * ] Notice: This patent issued on a continued prosecution application filed under 37 CFR 1.53(d), and is subject to the twenty year patent term provisions of 35 U.S.C. 154(a)(2).

[21] Appl. No.: 09/077,859

[22] PCT Filed: Dec. 4, 1996

[86] PCT No.: PCT/EP96/05395

§ 371 Date: Sep. 21, 1998

§ 102(e) Date: Sep. 21, 1998

[87] PCT Pub. No.: WO97/21372

PCT Pub. Date: Jun. 19, 1997

[30] Foreign Application Priority Data

Dec. 8, 1995 [DE] Germany ..... 195 45 787

[51] Int. Cl.[7] ..... F16M 13/00

[52] U.S. Cl. ..... 248/524

[58] Field of Search ..... 248/523, 516, 248/524, 527, 74.1, 519

[56] References Cited

U.S. PATENT DOCUMENTS

| | | | |
|---|---|---|---|
| 1,680,050 | 8/1928 | Keppens | 248/527 |
| 4,848,027 | 7/1989 | Skierwiderski | 47/42 |
| 5,014,461 | 5/1991 | Vom Braucke et al. | 248/523 |
| 5,160,110 | 11/1992 | Praegitzer | 248/523 |
| 5,797,579 | 8/1998 | Krinner | 248/523 |

FOREIGN PATENT DOCUMENTS

| | | | |
|---|---|---|---|
| 31 42 207 | 10/1994 | Germany | 248/523 |

*Primary Examiner*—Ramon O. Ramirez
*Attorney, Agent, or Firm*—Cooper & Dunham LLP

[57] ABSTRACT

Stands for substantially cylindrical, elongate objects, in particular Christmas trees. The stands have at least one retaining element into which the object is inserted. Resilient elements are attached to the retaining element, the resilient elements being designed as resilient clasps, each clasp having a sharpened tip which digs and wedges into the object when the object is inserted into the stand.

10 Claims, 2 Drawing Sheets

STANDS FOR CHRISTMAS TREES OR THE LIKE

Figure 1:
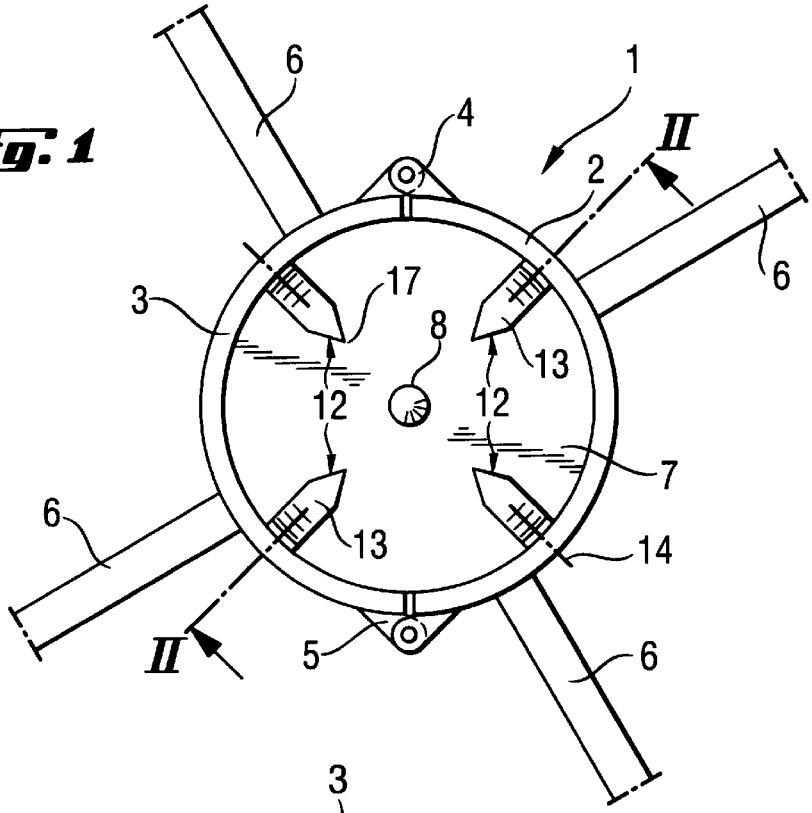

The invention relates to a stand for securing Christmas trees and similar objects, e.g. sunshades, fence posts, flagpoles, partitions and the like, it being the intention for said objects to be centered in a clamping-type mount of this stand.

A stand of this type has been disclosed, for example, by the subject matter of German Utility Model 94 03 811.

By way of this known arrangement, a description is given of a Christmas-tree stand on whose cross-shaped foot there are arranged inwardly directed resilient elements whose radially inwardly bent ends are bent radially outward again in the form of an arc, so as to provide a clamping-type mount for an approximately cylindrical object, it being the case that said resilient elements are positioned, against said object which is to be retained, merely by spring force and frictional locking, but without wedging into the object.

This has the disadvantage that said springs are only positioned by friction locking against the outer circumference of the object which is to be retained, e.g. the Christmas-tree trunk, which results in the latter being unstable.

Moreover, it is not possible to compensate for a crooked trunk by introducing the latter obliquely into the retaining means, because the resilient elements always act on the outer circumference of the trunk with the same spring force from all sides.

Moreover, it is further disadvantageous that the resilient elements are positioned against the trunk in a frictionally locking manner relatively close to the ground, and this gives a poor retaining action. The actual retaining action is effected, for the most part, by a relatively large, approximately star-shaped resilient element which, at the same time, forms the cross-shaped foot and a top, narrowed section into which it is intended to introduce the trunk which is to be retained.

In addition to the high outlay in terms of materials, and the associated high production costs, this solution has the disadvantage that the trunk, in turn, is only retained in a frictionally locking manner by the top, central resilient element, which forms the cross-shaped foot, and, in turn, said resilient element merely butts against the trunk in a frictionally locking manner.

This means, however, that the stability of the entire trunk in this stand is brought into question.

The object of the invention is further to develop a stand of the type mentioned in the introduction such that, along with considerably lower production outlay, more stable fastening of the object is ensured.

In order to achieve the set object, the invention is defined by the technical teaching of claim 1.

The essential feature of the invention is that one or more mutually opposite resilient elements are provided on the inner circumference of the retaining element, each resilient element comprising a resilient clasp which is fastened on the inner circumference of the retaining element so as to run obliquely downwards and, at its respective end, has one or more tips, it being the case that at least the tips are directed radially inwards.

The given technical teaching gives rise to the considerable advantage that, upon introduction of an object which is to be retained, preferably a Christmas-tree trunk or another type of object which is to be retained, the tips of the resilient elements dig into the object, preferably into the trunk, and this results in the tips being locked in the object with a positive and frictional fit, so that it is no longer possible for the latter to be released from the stand without outside intervention.

For the sake of simplicity, the following description will take as its departure point the task of securing a Christmas tree in a Christmas-tree stand, but the invention is not restricted to this, as has been emphasized a number of times above.

If, therefore, a Christmas tree is introduced into the retaining means from above, then the introduction operation takes place in a particularly straightforward manner because a wide variety of diameters can be introduced into the stand, ensuring great variability of diameters.

In a preferred configuration of the present invention, it has been established that a stand of this type is suitable for securing diameters in the range between 40 and 100 mm, but the invention is not restricted to this because, depending on the diameter of the retaining element (which then has to be of correspondingly larger or smaller design), it is also possible to retain very much larger or very much smaller Christmas-tree diameters.

The technical teaching described thus provides the advantage that, by way of their tips, the resilient elements described dig into the material of the object which is to be retained (Christmas tree) and wedge into the same.

A particularly good wedging action is achieved when the tips are each sharpened to form a cutting edge. Such sharpening is achieved in that the bottom edge of the respective resilient clasp is inclined less steeply than the top edge, thus providing a cutting edge such as that exhibited, for example, by a firmer chisel or other tools of this type.

The action of the tips of the resilient clasps digging into the tree trunk has the advantage that it is also readily possible to compensate for crooked tree growth since this crooked tree trunk may also be introduced obliquely into the retaining element and thus remain in an oblique position, because the resilient clasps wedge in, and prevent subsequent centering of the tree, when their tips dig in non-uniformly.

This gives the advantage that, once a tree has been introduced into the Christmas-tree stand, this can be jerked into alignment in another direction, as a result of which the tips of the resilient clasps are briefly oriented in their dug-in state and are then secured and wedged in this other, inclined position.

This wedging action of the tips in the material of the tree trunk is thus achieved with the tree trunk in any desired inclined position, without the tree trunk having to be pivoted back, in an undesired manner, into a central position. This was the disadvantage in the case of German Utility Model 94 03 811, which was mentioned in the introduction and in which the resilient elements always exert a uniform pressure from all sides on the trunk circumference and thus center a trunk uniformly, which results in a skewed trunk also being centered in a skewed manner.

It has been explained above that, in order to realize the idea of the invention, it is sufficient for one or more mutually opposite resilient elements to be arranged on the inner circumference of the retaining element, each resilient element essentially comprising a resilient clasp, of which one or more tips are directed radially inward and obliquely downward.

This embodiment also permits multi-part resilient elements, of which, for example, each resilient element comprises a first resilient clasp on which, as a further part, the respective tip is provided by way of an appropriate fastener.

It is likewise provided for the resilient clasp to be designed, along with its tip, as a single, integral part.

Likewise, it is not necessary to the solution for the resilient clasp to be aligned obliquely inward as such. It is sufficient here for the tip itself to be directed obliquely downward and radially inward in order to achieve said wedging action in the material of the tree trunk.

Such technical teaching covers a retaining element which is continuous and has said resilient elements arranged on its inner circumference.

When a tree trunk is introduced into such a continuous retaining element (which is designed, for example, as a tube), then said tree trunk is received non-releasibly in said retaining element. That is to say it cannot be released from the retaining element without further measures being taken. This is the first embodiment of the present invention.

In a further embodiment of the present invention, it is provided that the object which is to be retained is received releasibly in the retaining element.

The prerequisite for this is that the retaining element comprises at least two part-shells which are articulated to one another in a hinge-like manner, with the result that the part-shells can be opened and closed with respect to one another. In the closed state, the two part-shells then form an encircling, closed retaining element, whereas in the open state one part-shell can be pivoted away from the other, in order thus for it to be possible to release the object from the receiving space of the retaining element.

It is provided here that the previously mentioned resilient elements are arranged both on one part-shell and on the other part-shell. If, accordingly, one part-shell is pivoted away from the other, then the object is no longer retained in a stable position when the part-shells are opened because, as the part-shell is opened, the resilient elements are drawn out of the material of the tree trunk, and the tree trunk can very easily be released from the retaining element in this manner.

It is not necessary here to use just two part-shells; it is also possible to use more than two part-shells, which are combined in the manner of segments.

It is likewise not necessary for the part-shells to be connected to one another in a hinge-like manner; it is also possible for them to be connected together by appropriate tensioning straps, clamps and the like in order thus to form a continuous retaining element.

A preferred configuration of the invention provides two part-shells, the latter being held together in the manner of a piano hinge, each piano-hinge side being arrested by an appropriate pin.

If one then draws out one pin on one hinge side, this hinge side is freed and the entire part-shell can be pivoted open and closed via the other pin, which still remains in the piano hinge.

The prerequisite for this arrangement is thus a hinge pin which is approximately parallel to the longitudinal axis of the object which is to be retained.

Another configuration of the invention provides that part-shells are retained in a hinge pin which is arranged perpendicularly with respect to the longitudinal axis of the object which is to be retained, i.e. this hinge pin would then be arranged in the vicinity of the base plate, perpendicularly with respect to the longitudinal axis of the object which is to be retained.

This means that the two part-shells could then be swung apart from one another approximately in a star-shaped manner, this providing a particularly large receiving space.

The further embodiment mentioned briefly above provides that two or more part-shells are designed in the form of segments of a circle and are not connected directly to one another; they are then just combined to form a closed retaining body and are held together by one or more tensioning straps positioned on the outer circumference.

The present invention is not restricted to a particular shaping of the retaining element either. In a first configuration, the retaining element may be of approximately tubular design, it being possible to use a circular-cylindrical tube as well as hexagonal tubes, oval tubes, square tubes or the like.

It is not particularly necessary to the solution either for the retaining element to be provided with closed wall parts over its entire axial length.

It is sufficient here to provide, for example, a top, annular, encircling retaining element which is connected to a second annular retaining element, close to the ground, via appropriate vertical bars or connecting elements.

The subject matter of the present invention can be gathered not just from the subject matter of the individual patent claims, but also from a combination of the individual patent claims together.

All the details and features, in particular the spatial design illustrated in the drawings, which are disclosed in the documents, including the abstract, are claimed as being essential to the invention in so far as, in relation to the prior art, they are novel on their own or in combination.

Figure 2:
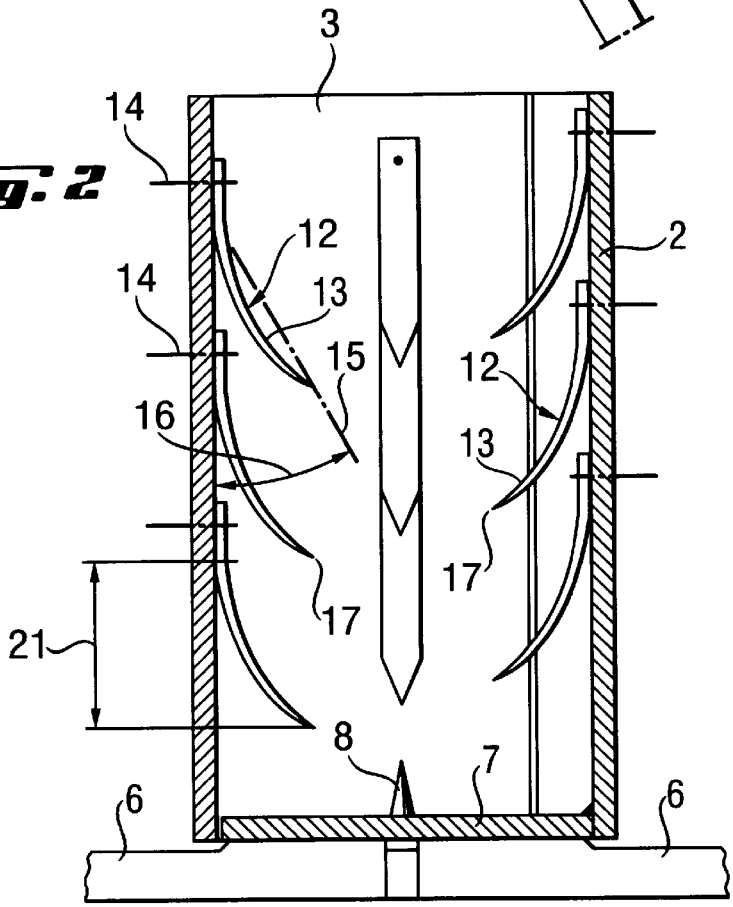
Figure 3:
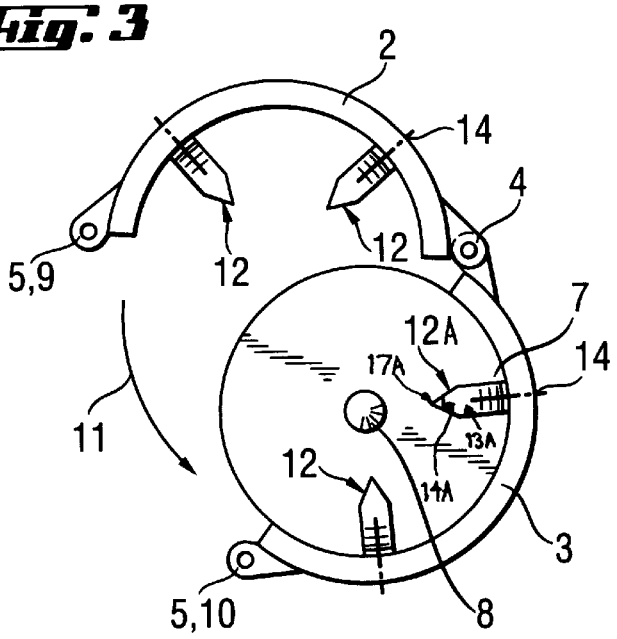
Figure 4:
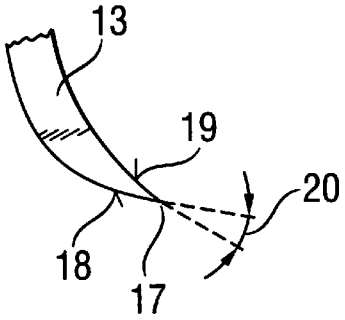
Figure 5:
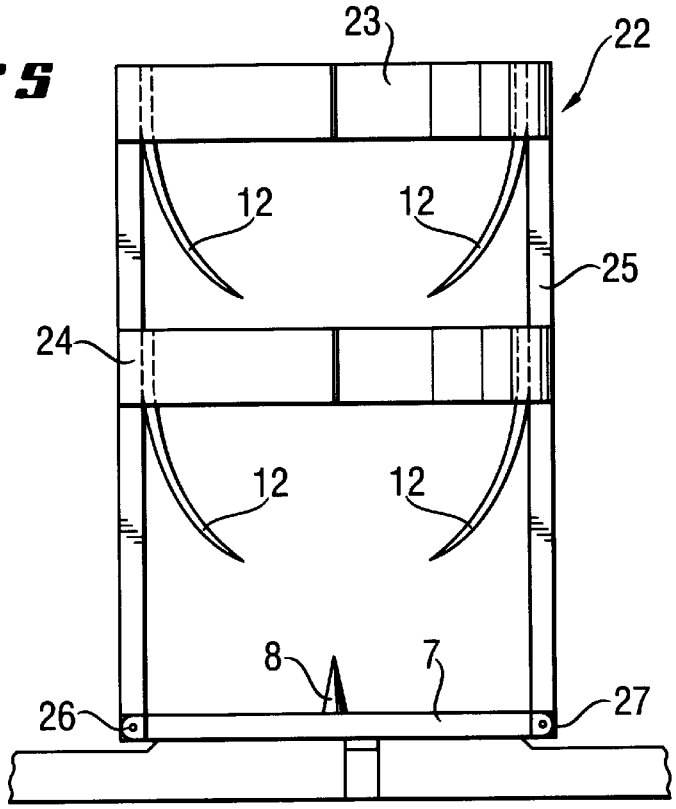

The invention will be explained in more detail hereinbelow with reference to drawings illustrating a number of methods of implementing the invention. Further features and advantages which are essential to the invention can be gathered from the drawings and the description of the same. In the drawings:

FIG. 1 shows a plan view of a first configuration of a stand according to the invention, FIG. 2 shows a section through the stand according to FIG. 1, in the direction of the line II—II, FIG. 3 shows, in a simplified illustration, the plan view of the arrangement according to FIG. 1 in the open state, and a view of one resilient member having a clasp and tip which separate elements, FIG. 4 shows the side view of a resilient tip, and FIG. 5 shows another configuration of a retaining element.

In the exemplary embodiment shown, the retaining element 1 is designed essentially from two part-shells 2, 3, which are essentially tubular. In this case, each part-shell 2, 3 is designed as a semicircular tube; the two semicircular tubes are connected to one another in a hinge-like manner. The mutually opposite hinges 4, 5 are each designed as a piano hinge and comprise, in a manner known per se, hinge sleeves 9, 10 (see FIG. 3), it being the case that mutually aligned hinge sleeves 9 are provided, at an axial distance from one another, on one half-shell 2 and are supplemented by corresponding hinge sleeves 10 which are arranged on the other part-shell 3.

When such a hinge 5 is closed, the hinge sleeves 9, 10 of the associated part-shells 2, 3 are aligned, with the result that an arresting pin (not illustrated specifically) can be introduced through this aligned inner hole.

In FIG. 3, an arresting pin (not illustrated specifically) has been introduced through the hinge 4, whereas the hinge 5 has had its arresting pin drawn out. This makes it possible for the two part-shells 2, 3 to be configured so as to be pivotable with respect to one another in the arrow direction 11 and in the direction opposite this.

Moreover, it is preferred here if the base 7 is integrally formed on one part-shell 3, said base bearing, in a manner known per se, an upwardly directed spike 8 in its central region.

It is also provided that a cross-shaped foot 6 is attached to the retaining element 1 for the purpose of setting down the latter on a floor or ground surface.

In order to improve handling, the cross-shaped foot 6 and the base 7 are provided on a part-shell 3. The second part-shell 2 can then be pivoted away relatively easily.

Another embodiment (which is not depicted) provides that the retaining element 1 is introduced into a ceramic shell or the like with appropriate retaining elements, with the result that said Christmas-tree stand is seated in a water bath and, as a result, water can be brought into contact with the trunk of the Christmas tree in order to keep the latter fresh for a longer period of time.

It is essential, then, for a series of resilient elements 12 to be arranged on the inner circumference of each part-shell 2, 3. Each resilient element 12 essentially comprises a resilient clasp 13 which, at its front end, merges into a downwardly and inwardly directed tip 17.

It is preferred here if the resilient clasp 13 and the tip 17 are formed integrally from a single material, e.g. a stainless spring steel, the spring steel having a thickness of, for example, 1.2 mm. A multipart resilient element 12A may also be used instead of the resilient element 12. The multipart resilient element 12A includes a resilient clasp 13A on which a respective tip 17A is attached by way of an appropriate fastener 14A.

It is important here for each resilient clasp 13 to be fastened on the inner circumference of the part-shell 2, 3 by appropriate fastening 14, and for at least two mutually opposite resilient elements 12 to be arranged in the receiving space of the retaining element 1, in order, on the two opposite sides, to dig into the trunk of the object which is to be retained.

In another configuration, it is also possible to provide three resilient elements, which are then distributed at an angle of 120° with respect to one another on the inner circumference of the retaining element.

The resilient clasps 13 are preferably fastened on the inner circumference of the part-shells 2, 3 in the direction of the straight line 15, which is oriented downward and inward, it being possible for the angle 16 to be in the range between 10° and 60°.

It is preferred here if the respective tip 17 of the resilient clasp 13 is designed in the manner of a cutting edge, as is illustrated in more detail in FIG. 4. In this case, the top edge 19 forms an angle 20 with respect to the bottom edge 18, the bottom edge 18 tapering to a shallower extent than the top edge 19, in order thus to form a bottom edge 18 which is designed in the manner of a cutting edge. This provides a chisel-like cutting edge which digs, in the manner of a firmer chisel into the material of the object which is to be retained.

The length 21 of the resilient clasp 13 may be more or less as desired. In the case of a conventional Christmas-tree stand, it may have a length, for example, in the range from 40 to 80 mm.

The exemplary embodiment according to FIG. 5 illustrates another form of retaining element 22, and it can be seen that said resilient elements 12 are arranged on a top ring 23.

It is then possible-to provide, in addition, a central or bottom ring 24, which likewise bears resilient elements. However, it is not necessary to provide this further ring 24. It is sufficient to provide a single ring 23. The ring 23 is then connected to the base 7 via vertically running bars 25.

The above-described opening mechanisms are provided for the purpose of opening such a retaining element 22. Either the ring 23 is split into a plurality of parts and comprises a plurality of part-shells, which are connected pivotably to one another via the hinges 4, 5, or the ring is in segments and is held together by an encircling tensioning strap -(not depicted).

It is likewise possible for the ring 23 to be split into two parts and, instead of the above-described hinge 4, 5 (with a hinge pin parallel to the longitudinal axis of the object which is to be retained), for a hinge 26, 27 to be provided, the hinge pin of the latter running approximately perpendicularly with respect to the longitudinal axis of the object which is to be retained. In this way, the above-mentioned ring 23—comprising a plurality of part-rings— could then be swung apart in a star-like manner.

A further configuration of the invention provides that it is-also possible for conventional Christmas-tree stands to be retrofitted with the Christmas-tree stand according to the invention. In this case, the cross-shaped foot 6 is dispensed with and said retaining element 1 can be introduced into a receiving space provided in an existing Christmas-tree stand.

Since the existing Christmas-tree stands usually have a round receiving space in which there engage three retaining screws which are offset with respect to one another by a circumferential angle of 120°, it is preferred if the retaining element is designed approximately as a triangular element or hexagonal element, in order for it to be possible for the existing screws to be positioned perpendicularly on the outer surfaces of the retaining element 1.

If such a retaining element 1 is introduced into a water trough, this provides the further advantage that, as a result of the tips 17 digging into the material of the tree trunk, the water can be brought into contact with the tree trunk better and with higher efficiency, and the tree thus remains fresh for a longer period of time.

Vastly improved handling is achieved overall. At the same time, the stability of the trunk in the stand is increased.

KEY TO DRAWINGS

1 Retaining member
2 Part-shell
3 "
4 Hinge
5 "
6 Cruciform foot
7 Base
8 Spike
9 Hinge sleeve
10 "
11 Arrow direction
12 Resilient element
13 Resilient clasp
14 Fastening
15 Straight line
16 Angle
17 Tip
18 Bottom edge (cutting edge)
19 Top edge
20 Angle
21 Length
22 Retaining member
23 Ring
24 "
25 Bar
26 Hinge
27 "

What is claimed is:

1. A stand for essentially cylindrical, elongate objects, comprising:

at least one retaining member for supporting the object inserted into the stand; and resilient elements provided on the retaining member, the resilient elements having resilient clasps provided with knife-like tips formed as separate elements from and connected releasably to the resilient clasps, each respective tip being formed as a sharp cutting edge for penetrating deep into the surface of the object inserted into the stand, so as to center and support the object without further action.

2. The stand as defined in claim 1, wherein a plurality of resilient elements are fixedly spaced around the circumference of the retaining member.

3. The stand as defined in claim 1, wherein a plurality of rows of resilient elements are provided above each other on the retaining member.

4. The stand as defined in claim 1, wherein the resilient elements are inclined downward and angled away from the surface of the retaining member toward the center of the stand.

5. The stand as defined in claim 1, wherein the tips of the resilient clasps are sharpened so that a bottom edge of the resilient clasp is less tapered than a top edge of the resilient clasp.

6. The stand as defined in claim 1, wherein the resilient clasps and the tips are integral.

7. The stand as defined in claim 1, wherein the retaining member comprises a plurality of rings which are connected to one another and are arranged one above the other.

8. The stand as defined in claim 1, further comprising a base with a spike, the base being connected to the retaining member via vertical members positioned between the base, and the retaining member.

9. The stand as defined in claim 1, wherein the shape of the retaining member is selected from the group consisting of round, triangular, hexagonal, oval and square.

10. The stand as defined in claim 1, further comprising a cruciform foot fastened on the retaining member.

* * * * *